US005748215A

United States Patent [19]

Swanson et al.

[11] Patent Number: 5,748,215

[45] Date of Patent: May 5, 1998

[54] INK-JET PRINTER INCLUDING INK CARTRIDGE WITH OPTIMUM SNOUT AND ALIGNMENT SURFACES

[75] Inventors: David W. Swanson, Escondido; George T. Kaplinsky, San Diego; James G. Salter, Sacramento; W. Wistar Rhoads, Escondido, all of Calif.

[73] Assignee: Hewlett-Packard Company, Palo Alto, Calif.

[21] Appl. No.: 496,044

[22] Filed: Jun. 28, 1995

Related U.S. Application Data

[63] Continuation of Ser. No. 995,221, Dec. 22, 1992, abandoned.

[51] Int. Cl.[6] ..... B41J 2/175; B41J 2/01

[52] U.S. Cl. ..... 347/87; 347/104

[58] Field of Search ..... 347/7, 86, 87, 347/93, 104

[56] References Cited

U.S. PATENT DOCUMENTS

| | | | |
|---|---|---|---|
| 3,482,258 | 12/1969 | Steen | 346/140 R |
| 4,422,084 | 12/1983 | Saito | 346/140 R |
| 4,429,320 | 1/1984 | Hattori et al. | 347/87 X |
| 4,500,895 | 2/1985 | Buck et al. . | |
| 5,245,361 | 9/1993 | Kashimura et al. | 347/87 X |
| 5,280,300 | 1/1994 | Fong et al. | 347/87 |

FOREIGN PATENT DOCUMENTS

| | | | |
|---|---|---|---|
| 0379151 | 7/1990 | European Pat. Off. . | |
| 0424133 | 4/1991 | European Pat. Off. | B41J 2/175 |
| 0437363 | 7/1991 | European Pat. Off. . | |
| 0516088 | 12/1992 | European Pat. Off. . | |
| 0519664 | 12/1992 | European Pat. Off. . | |
| 0021549 | 1/1987 | Japan | B41J 3/04 |
| 62-214961 | 9/1987 | Japan | 347/93 |
| 2003321 | 1/1990 | Japan . | |
| 2063175 | 6/1981 | United Kingdom . | |

*Primary Examiner*—Benjamin R. Fuller
*Assistant Examiner*—David Yockey
*Attorney, Agent, or Firm*—David S. Romney

[57] ABSTRACT

An ink-jet print cartridge is formed by a rigid outer protective case and an inner ink reservoir having a flexible wall portion and a rigid wall portion which together form a sealed compartment. The flexible wall portion includes two opposing membranes sealed at their periphery to an inner loop-like frame which is integrated with a portion of the outer case. The outer protective case also covers a snout having a shortened length in the media advance direction to allow media positioning rollers closely adjacent to the print zone. The snout includes internal filters in an ink passageway from the reservoir to print nozzles at the end of the snout.

1 Claim, 7 Drawing Sheets

FIG. 6A
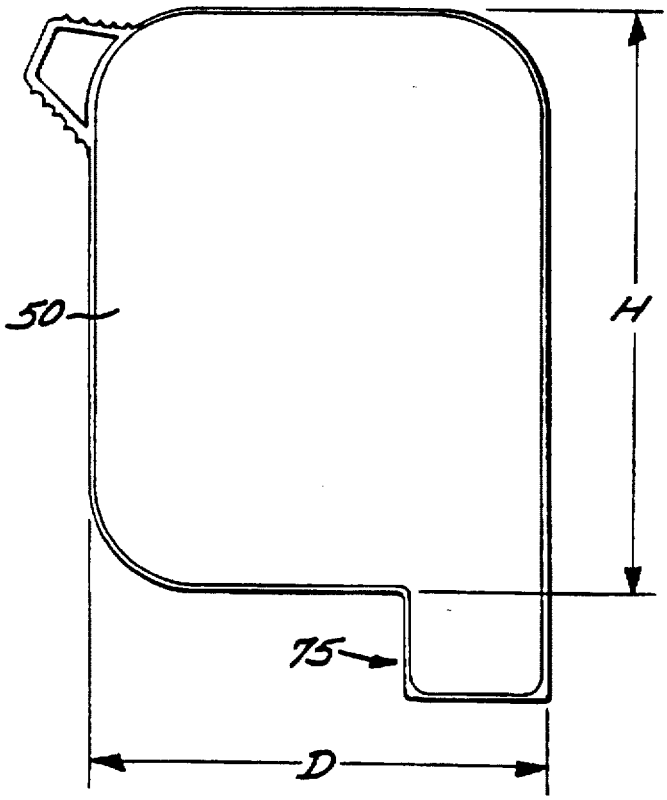
FIG. 6B
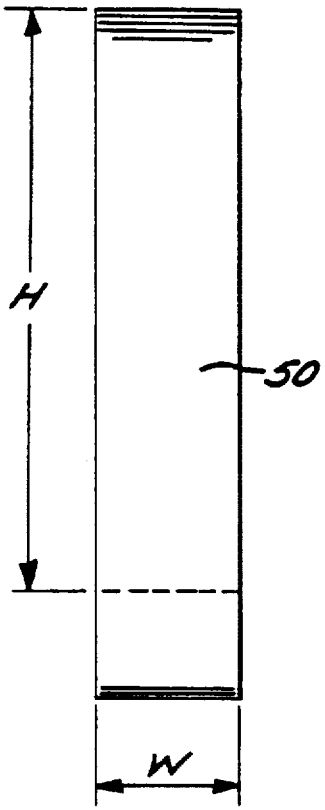
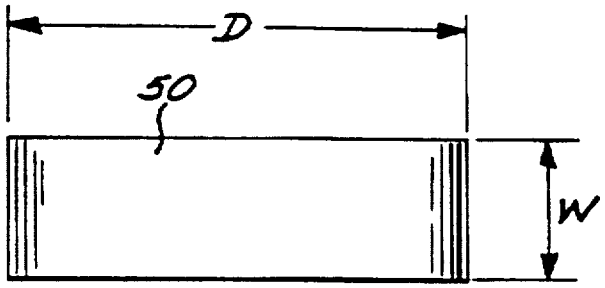
FIG. 6C

INK-JET PRINTER INCLUDING INK CARTRIDGE WITH OPTIMUM SNOUT AND ALIGNMENT SURFACES

CROSS REFERENCE TO RELATED APPLICATION(S)

This is a continuation of application Ser. No. 07/995,221 filed on Dec. 22, 1992, now abandoned.

The present invention is related to the following pending U.S. patent applications: A METHOD OF MAKING A COMPACT FLUID COUPLER FOR THERMAL INK-JET PRINT CARTRIDGE INK RESERVOIR, Ser. No. 07/853,372, now U.S. Pat. No. 5,464,578, filed Mar. 18, 1992, by James G. Salter et al.; INK PRESSURE REGULATOR FOR A THERMAL INK-JET PRINTER, Ser. No. 08/302,077, filed Aug. 12, 1992, by Tofigh Khodapanah et al.; COLLAPSIBLE INK RESERVOIR STRUCTURE AND PRINTER INK CARTRIDGE, Ser. No. 08/240,297, filed Aug. 12, 1992, by George T. Kaplinsky et al.; TWO MATERIAL FRAME HAVING DISSIMILAR PROPERTIES FOR A THERMAL INK-JET CARTRIDGE, by David W. Swanson et al., filed concurrently herewith, Ser. No. 07/994,807; RIGID LOOP CASE STRUCTURE FOR THERMAL INK-JET PEN, by David W. Swanson et al., filed concurrently herewith, Ser. No. 07/994,808.

THERMAL INK-JET PEN WITH A PLASTIC/METAL ATTACHMENT FOR THE COVER, by Dale D. Timm, Jr. et al., filed concurrently herewith, Ser. No. 07/994,810; THIN PEN STRUCTURE FOR THERMAL INK-JET PRINTER, by David W. Swanson et al., filed concurrently herewith, Ser. No. 08/266,477, now U.S. Pat. No. 5,491,507; NEGATIVE PRESSURE INK DELIVERY SYSTEM, by George T. Kaplinsky et al., filed concurrently herewith, Ser. No. 07/995,851; and SPRING BAG PRINTER INK CARTRIDGE WITH VOLUME INDICATOR, by David S. Hunt et al., application Ser. No. 07/717,735, now U.S. Pat. No. 5,359,353, filed Jun. 19, 1991; the entire disclosures of which are incorporated herein by this reference.

BACKGROUND OF THE INVENTION

This invention relates to thermal ink-jet (TIJ) printers, and more particularly to improvements in the pens used therein.

TIJ printers typically include a TIJ pen which includes a reservoir of ink coupled to the TIJ printhead. One type of pen includes a polymer foam disposed within the print reservoir so that the capillary action of the foam will prevent ink from leaking or drooling from the printhead. In such a pen, a fine mesh filter is typically provided in the fluid path between the reservoir and the printhead to trap particles before reaching the printhead and thereby interfering with printhead operations. This foam pen includes a vented air delivery system, wherein as ink is drawn from the ink reservoir during printing operations, air enters the reservoir via a separate vent opening.

The TIJ pen of the present invention as described in the referenced co-pending applications affords many benefits for the printing system built to utilize it. The pen is thin which directly reduces the required width of the printer carriage and subsequently the total width of the printer. The ink delivery system is simple and efficient. Ink is contained within a reservoir formed by two pieces of thin polyethylene bag material that have been thermally bonded to a compatible plastic material on the frame 60. Two pistons and a spring inside the bag provide backpressure to prevent ink from drooling out of the printhead, i.e., the ink is maintained under negative pressure within the reservoir. The frame 60 is made of two different plastic materials. One material is an engineering plastic forming the external surfaces and providing structural support and the second material provides the fluid path for the ink and is suitable for thermal attachment of the bag material. The thin metal sidecovers 70 and 80 protect the inside components, add considerable rigidity to the system, and allow for a high degree of volumetric efficiency (volume of deliverable ink compared to the external volume of the pen). Sidecovers made from a metal having a surface such a pre-painted or PVC clad material are used to cover the springbag and other components of this TIJ pen.

SUMMARY OF THE INVENTION

The invention provides an ink cartridge having an outer protective case which carries an inner ink reservoir in order to facilitate and optimize their respective functions. The inner ink reservoir is defined by a flexible wall portion and a rigid wall portion which together form a sealed compartment after the reservoir has been filled with ink and the inlet hole closed. The outer protective case protects the ink reservoir from damage such as puncturing as well as from any compressive forces which might result in ink leakage. As ink passes from the reservoir to a firing chamber for ejection through orifice nozzles onto media, the flexible wall portion moves from a filled position to a partially filled intermediate position to an empty position. In the preferred form, the flexible wall portion includes two opposing membranes which are heat sealed at their periphery to an inner loop-like frame which is integrated with an outer frame member. Side plates are provided for attachment to the outer frame member in order to completely enclose the reservoir while still allowing some airflow to pass back and forth into the space occupied/vacated by the ebbing/expanding reservoir. The outer protective case also covers a snout which provides a passageway from the reservoir to the orifice nozzles. The snout extends from the main body of the cartridge and includes internal filters and an external head for the orifice nozzles. The snout has a shortened length in the media advance direction to allow sufficient space for media positioning rollers closely adjacent to the print zone.

BRIEF DESCRIPTION OF THE DRAWINGS

These and other features and advantages of the present invention will become more apparent from the following detailed description of an exemplary embodiment thereof, as illustrated in the accompanying drawings, in which:

FIGS. 6A–6C show side, front, and top plan views of the pen of claim 3.

DETAILED DESCRIPTION OF THE PREFERRED EMBODIMENT

Figure 1:
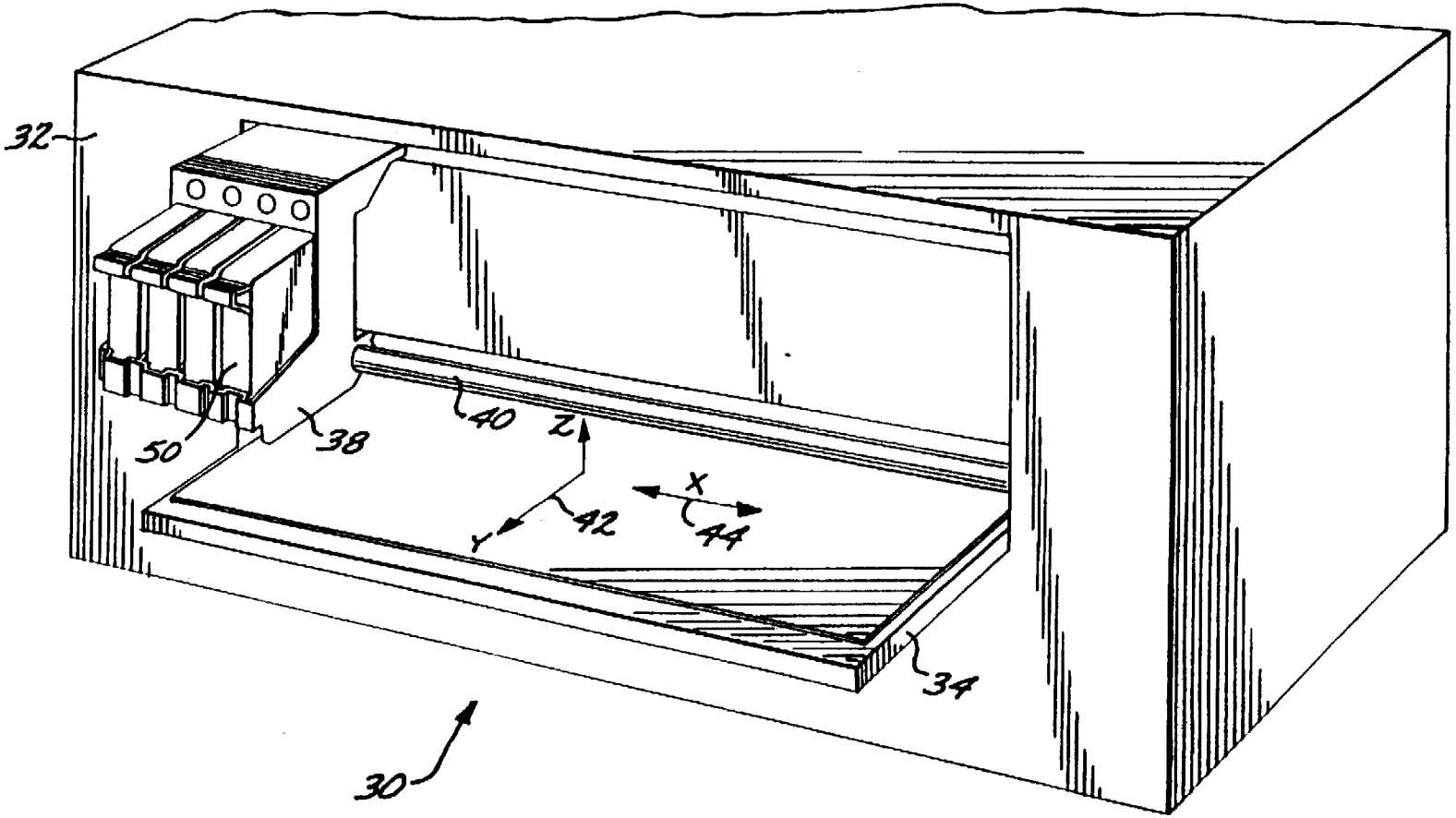
FIG. 1 is an isometric view of a printer device embodying this invention.

FIG. 1 illustrates a TIJ printer 30 embodying the present invention. The printer includes a housing 32 which supports various elements including the platen 34 which supports the print medium 36 such as a sheet of paper. The printer includes a pen carriage 38 which is driven along the support shaft 40 to eject drops of ink from the pens 50 onto the print medium. As is well known in the art, the printer further includes media advancement mechanisms not shown in FIG. 1 to advance the medium in the Y direction of arrow 42 along the medium advancement axis to position the medium for the next successive transverse swath carried out by the carriage 38 along the scan axis 44. According to one aspect of the invention, the carriage 38 holds a plurality of thin pens 46, and is relatively narrow due to the thinness of the pens along the X direction 44 of carriage movement. As a result, the required width of the printer 30 can also be relatively smaller than in prior designs. Further, the depth dimension of the pen is smaller than the height dimension, thereby minimizing the pen footprint while providing a high volume pen. This permits further a reduction in the printer footprint size.

Figure 2:
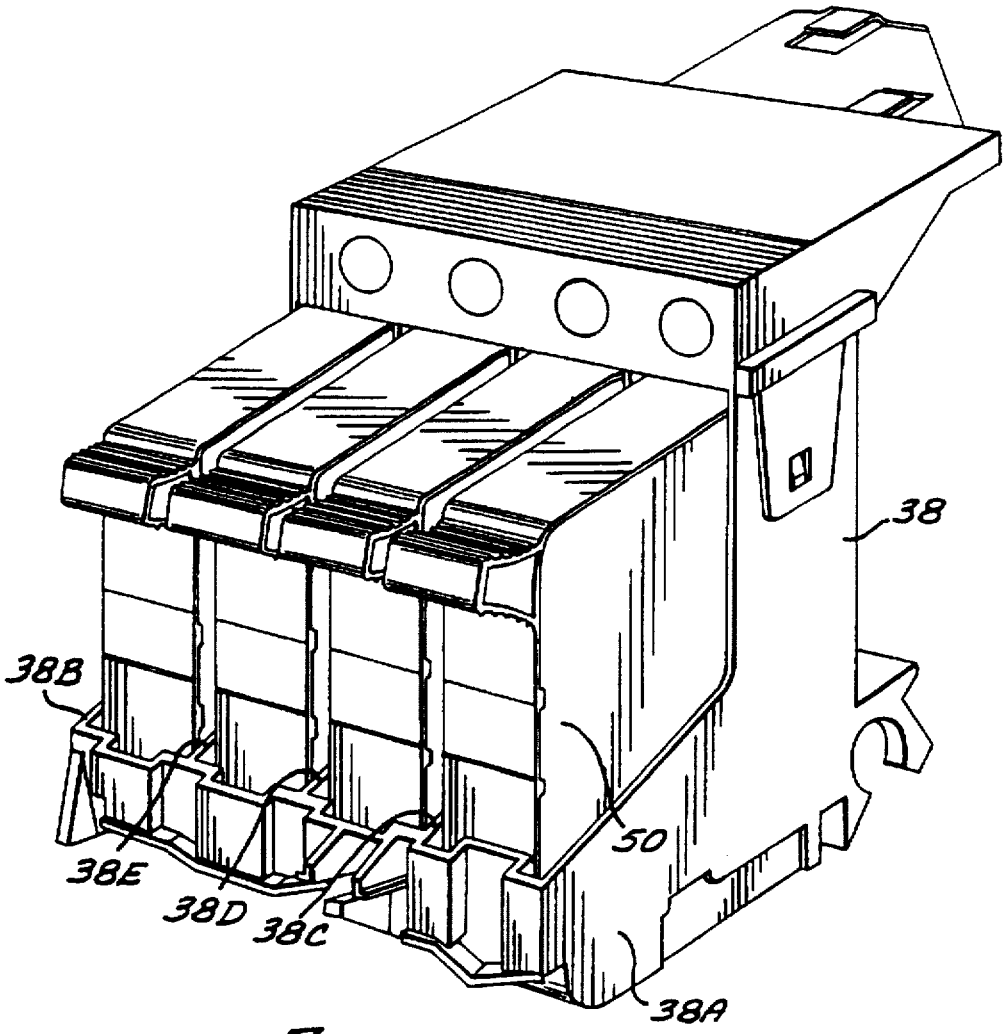
FIG. 2 is an isometric view of the pen carriage of the printer of FIG. 1.
Figure 3:
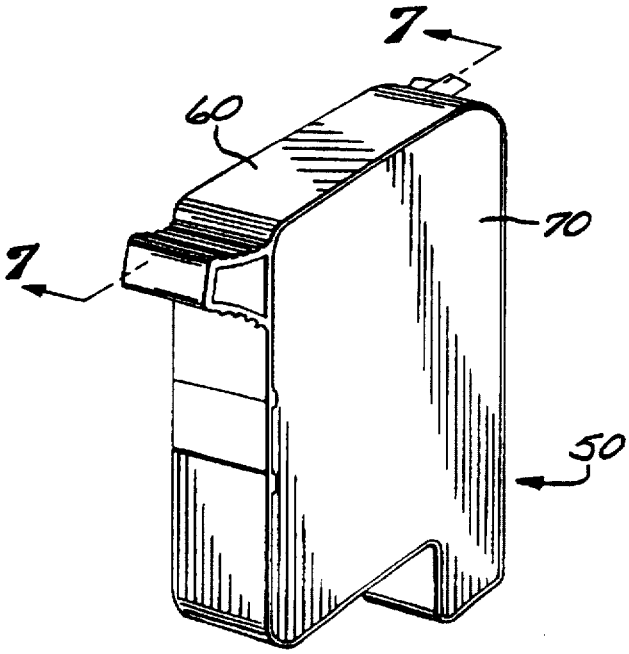
FIG. 3 is an isometric view of a printer pen in accordance with this invention.

In the preferred embodiment, the carriage 38 is adapted to carry four pens 50, each of a different color, for example, black, cyan, magenta and yellow. The pens 50 are secured in a closely packed arrangement, and may be selectively removed from the carriage for replacement with a fresh pen. The carriage 38 includes a pair of opposed side walls 38A and 38B, and spaced short interior walls 38C–E, which define pen compartments (FIG. 2). The carriage walls are fabricated of a rigid engineering plastic, and are thin; in this embodiment the carriage walls have a thickness of about 0.08 inches (2 millimeters). The printheads of the pens 50 are exposed through openings in the pen compartments facing the print medium.

Figure 4:
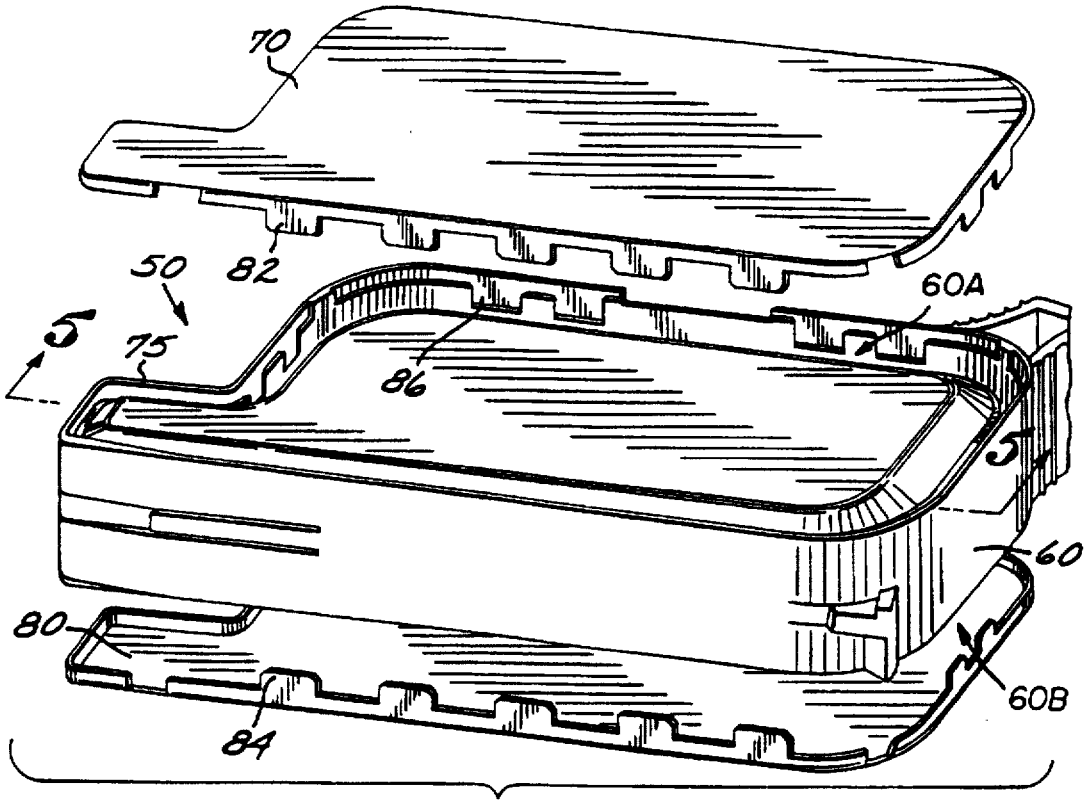
FIG. 4 is an exploded isometric view of the pen of FIG. 3.
Figure 5:
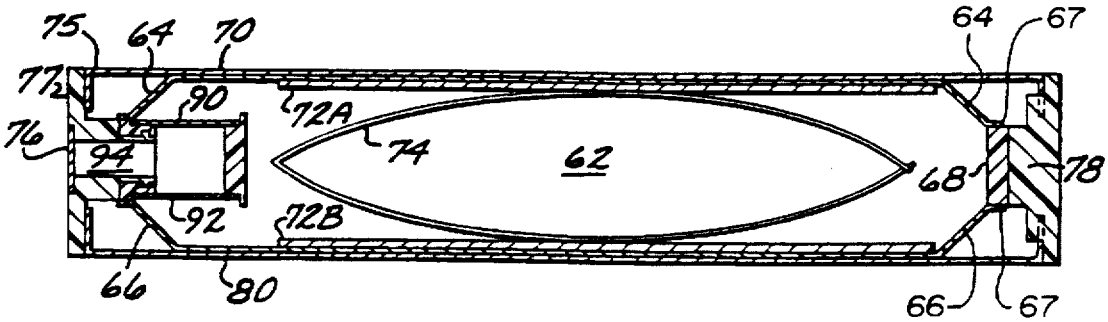
FIG. 5 is a cross-sectional view taken along line 5—5 of FIG. 4.

FIGS. 3–9 illustrate a TIJ pen 50 embodying the invention. The pen includes an external pen case structure comprising frame structure 60 and a pair of side covers 70 and 80. The frame structure 60 defines a closed band, i.e., a closed frame loop, and first and second opposed side open areas 60A, 60A on either side of the band or loop. A pen snout region 75 is defined at one corner of the pen 50, and a TIJ printhead is secured at the end 77 of the snout region 75 (FIG. 5). TIJ printheads are well known in the art, and include a plurality of print nozzles disposed in a printhead plane. In this exemplary embodiment, the nozzles eject ink droplets in a direction generally orthogonal to the printhead plane. For purposes of defining the orientation of the pen, the "vertical" direction is considered to be the direction normal to the nozzle plane. The pen 50 and carriage 38 are also provided with electrical wiring elements (not shown) to connect the printhead 76 to the printer controller to control the operation of the printhead, as is well known in the art.

In this exemplary embodiment, the pens 50 are secured in the carriage 38 such that the longest pen dimension, the height dimension, extends generally along a vertical direction, with the print medium disposed below the pen printheads in a generally horizontal position. While such a configuration minimizes the pen footprint, the invention is not limited to such a "vertical" orientation of the pen. The pen may also be disposed, for example, such that the longest pen dimension extends along the horizontal, and the print medium is disposed along the vertical in the printing area.

The pen 50 includes a simple and efficient ink delivery system, more fully described in the above-reference pending applications, Ser. Nos. 08/302,077 and 08/240,297. Generally, ink is contained within a reservoir 62 formed by two pieces 64 and 66 of thin polyethylene bag material bonded to an inner frame element 68 fabricated of a compatible plastic material secured to the external frame element 78. Two piston plates 72A and 72B and a spring 74 inside the reservoir 62 provide backpressure, i.e., negative pressure, to prevent ink from drooling out the nozzles of the TIJ printhead 52.

The frame structure 60 includes two elements 68 and 78, made of two different plastic materials. Element 78 is an external frame element, fabricated of a first material, preferably an engineering plastic forming the external surfaces and providing structural support. An exemplary plastic suitable for the purpose is polyphenyleneoxide (PPO). The element 68 is an interior frame element, fabricated of a second plastic material, which provides the fluid path for the ink and is suitable for attachment of the bag membranes 64 and 66, as described more fully in the above-referenced pending application Ser. No. 07/853,372, now U.S. Pat. No. 5,464,578. An exemplary plastic suitable for the second plastic material is a polyolefin alloy or a glass-filled polyethylene. A preferred material for the membranes 64 and 66 is ethylene-vinyl acetate (EVA).

A pair of elements 90 and 92 are disposed in the fluid path between the reservoir 62 and the ink chamber 94 for the printhead 76. Elements 90 and 92 are fine mesh screens which serve as air bubble check valves and particulate filters, preventing air bubbles from entering the reservoir from the printhead nozzles, thereby reducing the negative pressure of the spring bag. The elements 90 and 92 also prevent particles from passing from the reservoir to the printhead and clogging the printhead nozzles. The elements 90 and 92 are more fully described in the referenced patent application entitled "Combined Filter/Air Check Valve for Thermal Ink-Jet Printer."

While the ink reservoir comprises a negative pressure spring bag reservoir in the preferred embodiment, the reservoir need not employ this particular spring bag embodiment. Accordingly, the invention is not limited to the particular ink delivery system employed by the pen.

The covers 70 and 80 may be fabricated of any suitable material; in this exemplary embodiment, the covers are fabricated of metal. The thin metal side covers 70 and 80 protect the inside components, add considerable rigidity to the system, and allow for a high degree of volumetric efficiency. The covers 70 and 80 can be fabricated of a pre-processed metal, such as metal having a pre-painted surface or a PVC clad metal to provide an aesthetically complete appearance. The covers 70 and 80 must be very rigid to prevent ink from being squeezed out in the event force is applied against the covers, e.g., during handling of the pen. An exemplary material from which the covers 70 and 80 may be fabricated is low carbon steel having a thickness of 0.019 inches.

The metal covers 70 and 80 may be attached to the plastic frame 60 by adhesives or screw fasteners, or by use of thermal or ultrasonic processes. However, as described in the co-pending application referenced above and entitled "Thermal Ink-Jet Pen with a Plastic/Metal Attachment for the Cover", the problem of attaching a cover to a thin plastic frame is solved by designing a series of metal tabs 82 and 84 on the covers 70 and 80 that will lock onto mating plastic features on the frame 60, e.g. slot 86 (FIG. 4). The tabs displace plastic on the mating features of the frame during assembly, allowing use of a simple mechanical press to assemble the cover to the frame, with no adhesives, screws, thermal or ultrasonic processes. The design of the cover tabs also enables them to lock into the frame; and the addition of chamfered corners on the tab aids assembly by providing a lead-in surface. The resulting cover/frame seam will resist shear, axial and transverse forces that occur in the joint as a result of externally applied loads to the pen. This joint allows for use of cosmetically suitable cover materials (e.g., pre-painted metal, PVC clad metal, or metals having a suitable cosmetic surface).

FIGS. 6A–6C show respective side, front, and top views of the pen 50. These views illustrate the respective proportions of the width W, height H and depth D of the body of the pen. According to one aspect of the invention, in order to provide a narrow pen while at the same time providing a pen having substantial ink reservoir capacity, the height and depth dimensions are selected to be at least twice the width dimension. In an exemplary embodiment, the dimension W is 18.8 mm (0.73 inches), the dimension D is 60 mm (2.37 inches), and the dimension H is 78 mm (3.07 inches). Such a relatively high and narrow pen body permits the required carriage travel along the scan axis to be substantially reduced over previous pen designs, while at the same time providing substantial body volume which generally equals if not exceeds that of available ink reservoir in such previous designs. The pen snout region 75 has a width equal to the width W of the pen body.

It will be seen from FIGS. 1 and 2 that the pen 50 is designed such that the narrow dimension W of the pen 50 is aligned with the scan axis 44 along which the pen is driven with the carriage 38. It is this narrowness of the width W of the pen 50 which results in a reduction of the width of the carriage 38 and the consequent reduction in the width of the printer housing 32. The dimensions H and D (FIG. 6) are measured along axes which extend orthogonally to the axis 44 with which the narrow dimension W is measured. The carriage 38 positions the pen snout region 75 and the printhead 76 above and spaced from the upper surface of the print medium 36.

An exemplary embodiment of the pen 50 can be fabricated to have an ink capacity of 42.5 cc, with a pen width of about 19 mm. This capacity versus width ratio (42.5 cc/19 mm=2.24 cc/mm) may be compared with other ink cartridges on the market today. For example, the HP 51608A cartridge has a width dimension along the carriage axis of 31 mm, and an ink capacity of 19 cc (0.61 cc/mm). The HP 51606A cartridge has a similar width dimension of 28 mm, with an ink capacity of 12 cc (0.43 cc/mm). The invention presents a clear advantage of ink capacity for a given carriage travel distance, thereby minimizing the required width of the printer.

Figure 7:
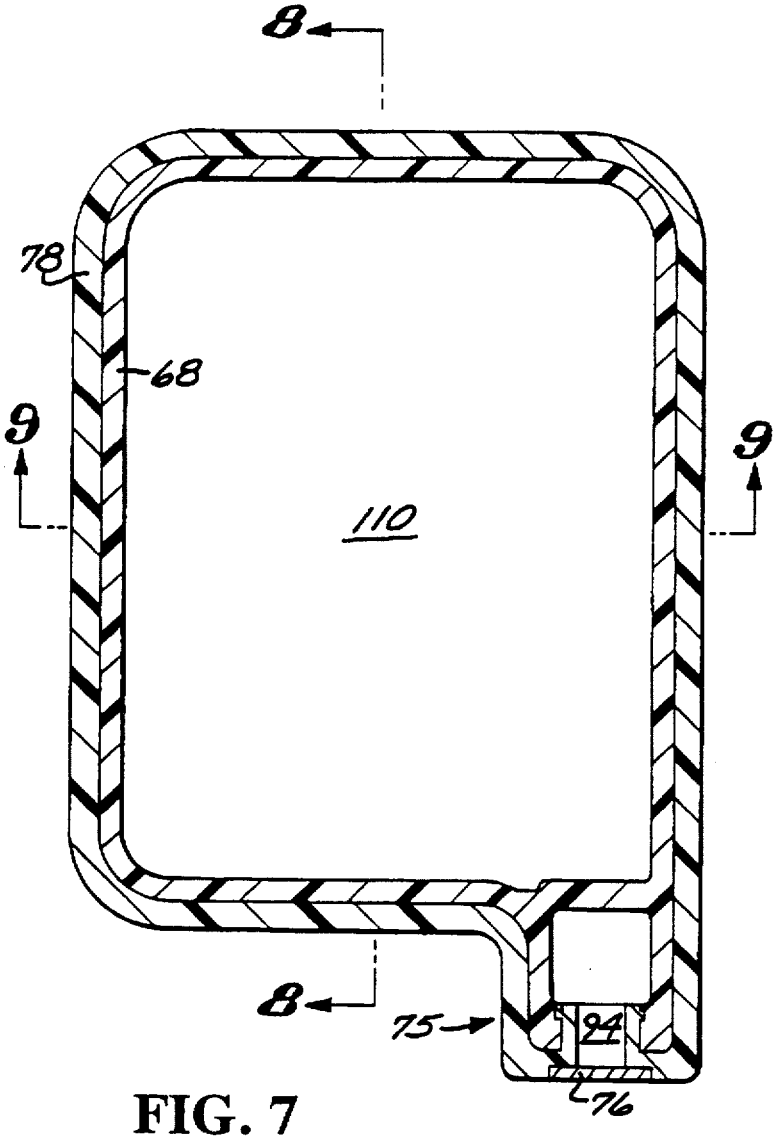
FIG. 7 is a cross-sectional view taken along line 7—7 of FIG. 3.

FIG. 7 illustrates the rigid open loop formed by the exterior frame element 78. Taken along line 7—7 of FIG. 3, and omitting the internal ink reservoir bag and spring elements for clarity, the cross-sectional view of FIG. 7 shows the open area generally circumscribed by the loop.

Figure 8:
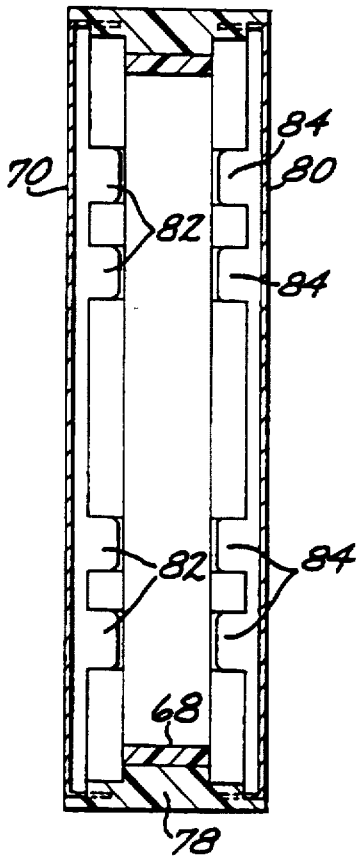
FIG. 8 is a cross-sectional view taken along line 8—8 of FIG. 7.
Figure 9:
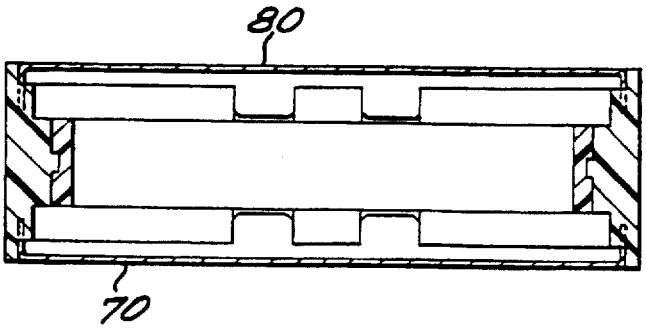
FIG. 9 is a cross-sectional view taken along line 9—9 of FIG. 7.

FIGS. 8 and 9 are orthogonal cross-sectional views taken along lines 8—8 and 9—9 of FIG. 7, also omitting the internal ink reservoir bag and spring elements for clarity. These views indicate the attachment of the covers 70 and 80 to the frame 60 by use of the tabs 82 and 84 pressed into engagement with recessed features such as feature 86 (FIG. 4) formed into the external plastic frame element 78. As shown in these views, the tabs attach to the frame element 78 on all sides of the frame element.

According to another aspect of this invention, the covers 70 and 80 are made of a material which is stronger than the material from which the frame element 78 is made. Thus, the frame element 78 is formed of a first material characterized by a first strength modulus value, and the covers 70 and 80 are formed of a second material characterized by a second strength modulus value, wherein the second strength modulus value is greater than the first value. As a result, the elements 70, 78 and 80 define a rigid external case structure for a TIJ pen which resists without substantial deformation compression forces applied normally to the plane of the covers, and as well forces applied to the case structure generally normal to the element 78 and parallel to the covers 70 and 80. Thus, the rigidity of the external case structure prevents, for example, the covers from being deflected inwardly in response to typical compression forces likely to be experienced by the case structure in normal storage or handling, to reduce the volume available for the ink reservoir supply. Such deflection could well cause ink to drool out of the printhead nozzles.

By way of example, the engineering plastic marketed under the trademark "NORYL GFN2" (20% glass-filled NORYL) by the General Electric Company, used in the preferred embodiment to fabricate frame element 78, has a Tensile modulus value on the order of $9.25\times10^5$ psi. A preferred material from which the covers may be fabricated is mild steel, which has a Young's modulus value on the order of 25,000 to 33,000 Kpsi. A plastic material, marketed by E. I. de Nemours DuPont Company under the commercial trade name "Kapton," could alternatively be used to fabricate the covers, and has a Young's modulus value on the order of 10,000 psi.

By using a cover material which is stronger than the material of the frame element 78, thin covers can be used to span the open area 110 without the need for additional cover support structure such as connecting webs or ribs extending into the interior of the area 110 and spanning the distance between the opposing covers 70 and 80. Such support structure could well be necessary to prevent deflection of thin covers made of a material of similar or weaker strength compared to the frame 78, but would provide the disadvantages of reducing the volume within the case structure which is available to the ink reservoir, complicating the design of the spring and bag elements, and driving up the cost of the pen. Of course, the use of a weaker material to fabricate thick covers to provide the strength necessary to prevent deflection in response to deflection forces would result in increasing the width dimension W of the pen, thereby increasing the carriage and printer width. Metal covers can be made much thinner, as much as five times thinner than plastic covers and can be injection molded. It is possible to use a thin plastic (in sheet form) as the cover, and weld a seam around the edge of the rigid loop frame structure. In this case, the thin plastic cover material is stronger than the frame 78 material.

Figures 10, 11:
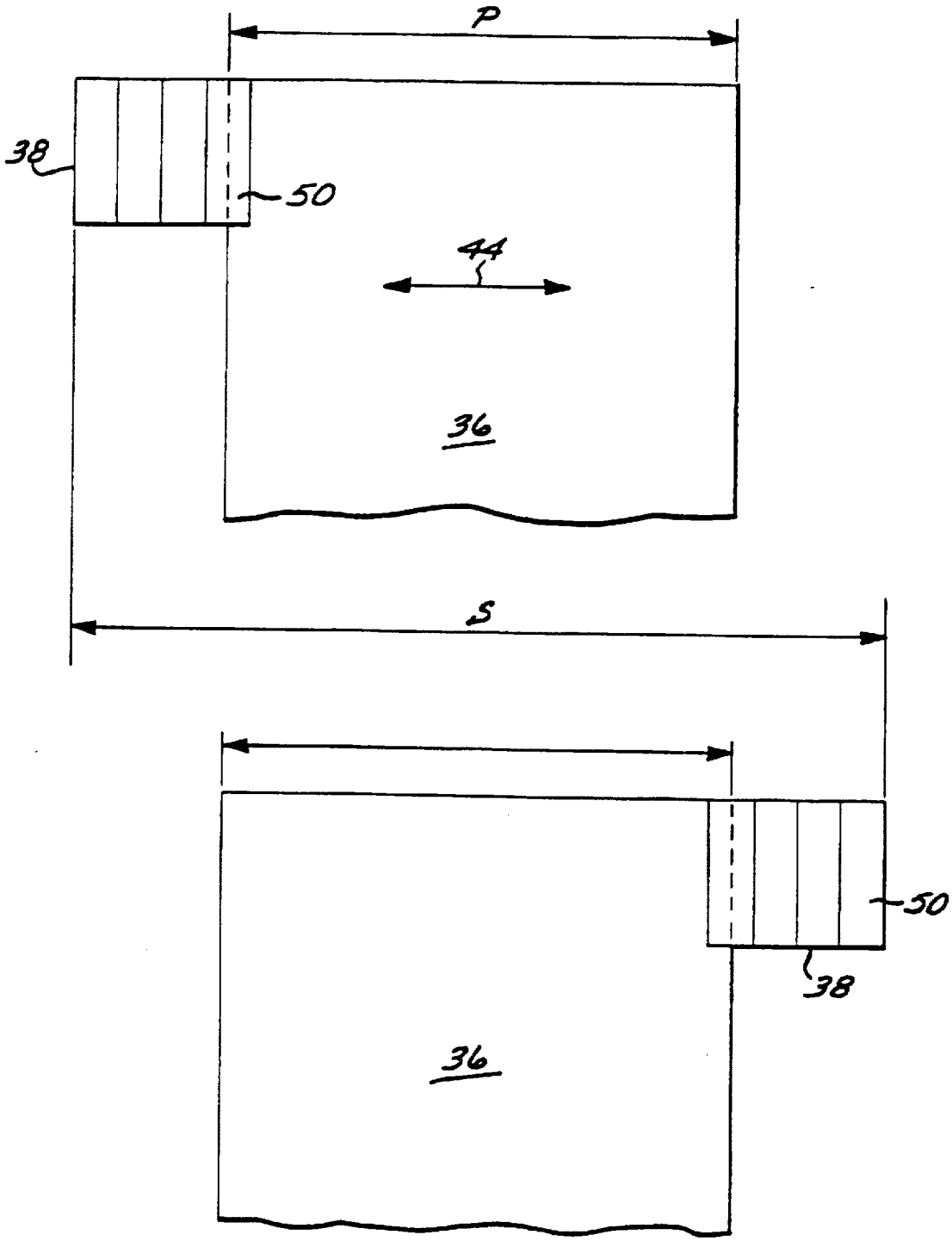
FIGS. 10 and 11 illustrate the positioning of the print carriage at opposing sides of the print media.

FIGS. 10 and 11 show the benefit of a reduced width pen structure in accordance with the invention, in reducing the required width of the printer. FIG. 10 shows the carriage 38 situated at the extreme left position of its scanning along axis 44. FIG. 11 shows the carriage 38 situated at its extreme right position. The total travel of the carriage to permit each pen printhead access to the full width of the print medium 36 is indicated as S, and is about equal to the width P of the medium 36 plus twice the width of the carriage 38. If the pen width W is, say 0.75 inches, and the pen mounts of the carriage require 0.25 inches per pen, the total carriage width can be made to be 4.0 inches. This can be contrasted with the conventional pen having a width of at least 1.25 inches and a required carriage width of at least 6.8 inches.

Figure 12:
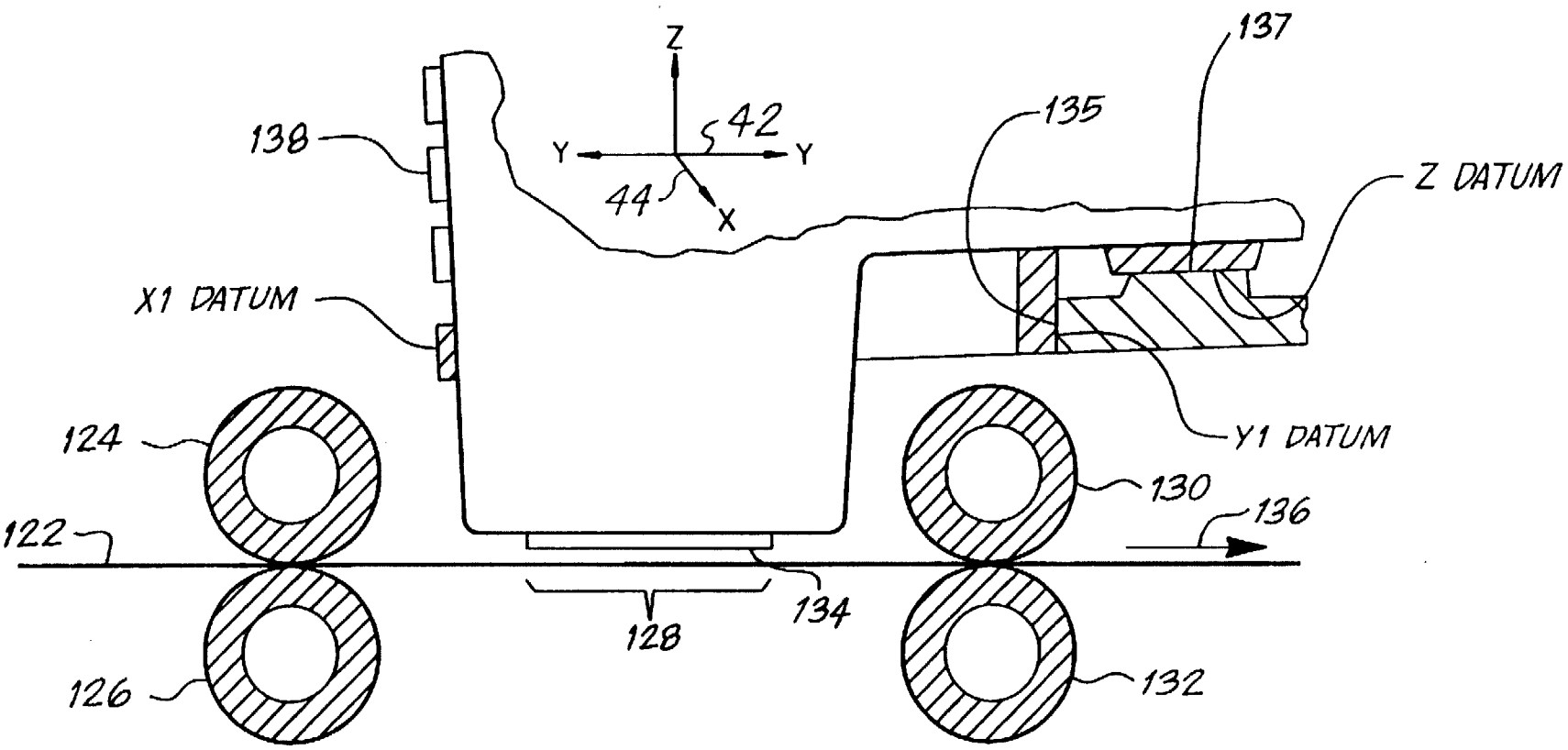
FIG. 12 is a schematic showing a pen snout in printing position.

FIG. 12 shows how a pen cartridge snout 120 can be positioned on a carriage (partially shown) immediately above a print zone while still allowing sufficient room for media stabilizing rollers to securely hold the media. In the illustrated embodiment, a sheet of media 122 passes between an entry pinch wheel/roller combination 124, 126 through a print zone 128 to an exit star wheel/roller combination 130, 132. Primary datums on the cartridge identified as the X1 datum, Y1 datum and Z datum are located on the snout in close proximity to a nozzle plate 134 to precisely position the cartridge in the carriage against matching carriage datums 135, 137 (matching carriage datum for X1 datum not shown) while at the same time being vertically displaced above the pinch wheel 124 and the star wheel 130. Additionally, most of the face portion of the snout in the media advance direction 136 is used for the nozzle plate in order to minimize the lateral distance from the print zone to the the media wheels/rollers. This snout configuration still allows for a relatively short flex-circuit from the nozzle plate to flex-circuit contacts 138 which provide the electrical interconnect to the corresponding circuits on the carriage.

It will therefore be understood by those skilled in the art that all of the aforemention features are interrelated to provide an ink cartridge having an outer protective case which uniquely carries an inner ink reservoir. The function of the outer case is to hold a nozzle plate securely and accurately in position in the carriage and over the print zone and to facilitate the transmission of electric signals from the carriage to the printhead to selectively fire ink from the nozzle orifices and optimize their respective functions. The function of the inner ink reservoir is to prevent air intrusion into the ink reservoir and to prevent contamination or leakage of the ink while at the same time allowing ink to flow freely into the firing chambers (not shown) under the nozzle orifices.

While, the double compartment feature of this invention is not limited to TIJ printers, it is particularly applicable to the spring-bag construction of the preferred mode for implementing the features of the invention. As shown in the drawings, the inner ink reservoir 62 is defined by an inner non-porous substantially non-elastic flexible wall portion and a rigid wall portion which together form a sealed compartment after the reservoir has been filled with ink and the inlet hole closed. The outer protective case formed by the frame structure 60 and metal side covers 70, 80 protects the ink reservoir from damage such as puncturing as well as from any compressive forces, either of which might result in ink leakage. Such leakage is easier to prevent in a fixed-wall ink reservoir, but in view of the superior volumetric efficiency of the spring/bag structure, it was very desirable to develop an inexpensive, reliable outer protective cover which could be successfully integrated with the reservoir.

As ink passes from the reservoir to a firing chamber for ejection through orifice nozzles onto media, the flexible wall portion moves from a filled position through partially filled intermediate positions to an empty position. In the preferred form, the flexible wall portion includes the two opposing bag membranes 64 and 66 which are heat sealed at their periphery 67 to the inner loop-like interior frame member 68 to form a sealed junction. In the preferred form, the interior frame member 68 is integrated with the outer loop-like external frame member 78 to form the rigid wall portion identified in the drawings as frame structure 60. Strong thin side plates which form the side covers 70, 80 are provided for attachment to the outer frame member 78 in order to completely enclose the reservoir while still allowing some airflow to pass back and forth into the space occupied/vacated by the ebbing/expanding reservoir.

In order to achieve simple manufacturability while also preventing ink leakage, the outer protective case also covers a snout which provides a passageway from the reservoir to the orifice nozzles. The snout is not part of the main reservoir which expands and contracts based on the ink volume therein, but it provides a separate compartment 140 which extends from the main body of the cartridge and includes internal filters and an external head for the orifice nozzles. The snout preferably has a shortened rear and forward length thereby being truncated in the media advance Y direction 42 to allow sufficient space for media positioning rollers closely adjacent to the print zone, in order to facilitate secure positioning of print media 122 in the print zone 128 as previously described, and to minimize the unsupported length of media as its leading edge is first fed through the printer and into the print zone by roller 126.

It is understood that the above-described embodiments are merely illustrative of the possible specific embodiments which may represent principles of the present invention. Other arrangements may readily be devised in accordance with these principles by those skilled in the art without departing from the scope and spirit of the invention.

We claim as our invention:

1. An ink-jet printer, comprising:

a printer carriage carrying an ink-jet cartridge and positioning the cartridge at a print area for ink-jet printing of ink droplets onto a surface of a print medium, said carriage including respective X, Y and Z carriage datum alignment surfaces;

print medium advancement apparatus for advancing print medium along a print media path to said print area, said apparatus including an input set of media control rollers/wheels and an output set of media control rollers/wheels, the print medium being engaged and driven between said input set of rollers/wheels and said output set of rollers/wheels, and wherein said ink cartridge comprises:

an outer casing suitable for mounting in said printer carriage;

an inner expandable ink reservoir completely surrounded by said outer casing, said reservoir formed by at least one flexible wall member and a rigid frame for holding a supply of ink in the ink cartridge;

a spring member located inside of said reservoir, said spring member including plate means engageable with said flexible wall member for creating negative pressure in said reservoir; and a snout structure incorporated as part of said outer casing and located adjacent to and extending outwardly from said inner expandable ink reservoir for transferring ink along a passage through a filter to a printhead, and wherein said outer casing includes an outer frame member of a first material for holding the printhead at the snout structure and including respective X, Y and Z cartridge datum alignment surfaces which are engageable against corresponding ones of the carriage datum alignment surfaces, and further includes side cover members of a second material for protecting said reservoir and snout means;

and wherein said outer casing has a casing dimension along a media advance direction, said snout structure has a snout dimension along said media advance direction, and said snout dimension is truncated relative to said casing dimension to permit close positioning of the input and output sets of rollers/wheels adjacent the printhead and thereby facilitate secure positioning of print media in said print area by said sets of media control roller/wheels;

and wherein said X, Y and Z cartridge datum alignment surfaces are vertically displaced above said input and output sets of rollers/wheels so that said cartridge and carriage datum alignment surfaces do not interfere with said close positioning of the sets of rollers/wheels.

* * * * *